US005092139A

United States Patent [19]

Runser

[11] Patent Number: 5,092,139

[45] Date of Patent: Mar. 3, 1992

[54] INSTALLATION FOR THE HEAT-SETTING OF TEXTILE YARNS

[75] Inventor: Henri Runser, Pfastatt, France

[73] Assignee: Passap S.A., Mulhouse, France

[21] Appl. No.: 618,378

[22] Filed: Nov. 27, 1990

[30] Foreign Application Priority Data

Nov. 29, 1989 [FR] France ..... 89 15721

[51] Int. Cl.[5] ..... D06B 3/02

[52] U.S. Cl. ..... 68/5 D; 28/281

[58] Field of Search ..... 68/5 D, 5 E; 28/281

[56] References Cited

FOREIGN PATENT DOCUMENTS 1379375 10/1964 France .
2317394 2/1977 France .
2594860 8/1987 France .
2596079 9/1987 France .

*Primary Examiner*—Philip R. Coe
*Attorney, Agent, or Firm*—Young & Thompson

[57] ABSTRACT

The installation for the heat-setting of textile yarns comprises a tubular heating and steam-treatment chamber (1) partially filled with water and connected at its opposite ends to two tubular cooling chambers, these chambers being traversed longitudinally by a movable belt (4) conveying the yarn to be treated. The belt (4) extends at a distance (D) above the longitudinal axis (X-X') of the heating and treatment chamber (1) which is between 1/10 and 1/6 of the diameter of the chamber. The width of said belt (4) is greater than 60% of the diameter of the chamber (1), and the water level (N) in the chamber (1) is situated at more than 1/10 of its diameter beneath the longitudinal axis (X-X') of this chamber (1). Use for increasing the productivity of the installation and for improving the quality of the treated yarn.

4 Claims, 4 Drawing Sheets

INSTALLATION FOR THE HEAT-SETTING OF TEXTILE YARNS

Figure 1:
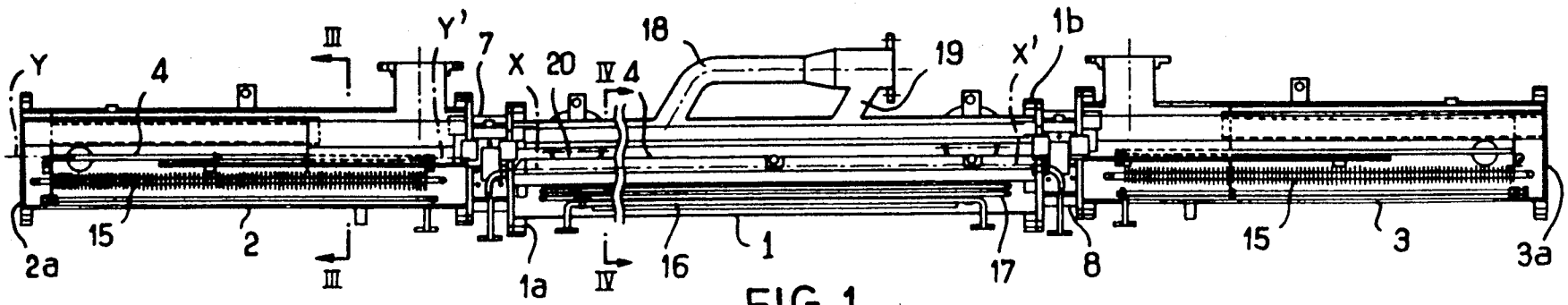

The present invention relates to an improved installation for the heat-setting of textile yarns.

Heat-setting is understood to mean a heat treatment in the presence of water vapor, with the intention of heat-setting the fibers constituting a yarn in order to make the latter suitable for the manufacture of carpets or moquettes. The present case essentially concerns carpet yarns generally consisting of polyamide 6, polyamide 66, polyester, polypropylene, wool, or mixed fibers. The heat treatments can be carried out with the aid of hot air containing saturated, wet or superheated steam. Nevertheless, in order to obtain good heat-setting, the saturated steam is still the most appropriate treatment fluid.

Depending on the type of fiber to be treated and the desired results, the saturated-steam treatment temperatures can range from approximately 105° to 150° C.

It is therefore clear that in order to obtain saturated steam at these temperatures, the treatment chambers must operate under pressure.

The known installation, designed by the applicant, for the heat-setting of textile yarns comprises a chamber for the heat-setting of textile yarns, comprising a tubular heating and steam-treatment chamber, partially filled with water and connected at its opposite ends to two tubular cooling chambers, which are themselves closed at their end by a sealing device essentially composed of rubber-coated rollers enabling both all the chambers to be maintained under pressure, and the belt conveyor supporting the layer of yarn to be treated to pass through. These chambers are traversed longitudinally by a movable belt conveying the yarn to be treated. The water contained in the (heat-setting) treatment chambers is heated by heating coils permitting, by way of a temperature- and pressure-control system, the saturated steam necessary for the treatment of the textile yarns to be generated inside.

This yarn to be treated is deposited in successive parallel circular coils or successive oblong coils perpendicular to the belt, and thus forms a layer which substantially occupies the entire width of this belt.

This belt extends in the cooling chambers substantially in a horizontal diametral plane of these chambers.

Moreover, in this known installation, the longitudinal axis of the heating and steam-treatment chamber is offset relative to that of the cooling chambers and is thus situated at a level below that of the latter. For this reason, the ends of the cooling chambers are connected to the ends of the heating and treatment chamber by way of oblique connection pieces. The belt conveying the yarn to be treated consequently extends above the longitudinal axis of the heating and treatment chamber. This belt also extends at a certain distance above the water contained in the abovementioned chamber, the level of which almost reaches the horizontal plane situated in the longitudinal axis of this chamber.

In this known embodiment, the diameter of the tubular chambers is equal to 400 mm, and the belt conveying the yarn to be treated extends at a distance of 10 cm above the longitudinal axis of the heating and treatment chamber.

When the applicant designed this installation, it was considered essential to keep to the above distance so as to maintain the belt at a sufficient distance above the water level in the abovementioned chamber, which, as mentioned above, almost reaches the longitudinal axis of this chamber, so as to prevent any risk of contact between the yarn conveyed by the belt, and this water.

Moreover, at this time the applicant considered it to be vital to ensure that the water level in the abovementioned chamber substantially reaches the longitudinal axis of this chamber so as to maintain the latter in a saturated-steam atmosphere and at optimum temperature.

The applicant company has set itself the task of improving the productivity of the above known installation, namely modifying the latter so that it can treat a larger quantity of yarn during a given period.

The applicant has also studied the problem of improving the quality of the treatment carried out on the yarn. Indeed, it has noted that textile articles such as moquettes and carpets obtained using the yarn treated by the installation had faults spread regularly over the above articles.

It noted that these faults were caused by the fact that the yarn, wound on the belt in the form of successive circular coils parallel to the belt (extending flat on the latter) or in the form of successive oblong coils perpendicular to the belt, formed on the latter a layer of yarn, the yarn density of which is greater on the edges of the belt than on its central part. The heat-setting of the yarn, effected by the joint effect of the heating and the steam, is thus carried out under less good conditions, on those parts of the yarn situated near the edges of the belt, than elsewhere. This deficiency thus translates into visible faults on certain sensitive textile articles made using the treated yarn.

The increase in the productivity of the installation could be obtained by increasing the speed at which the belt runs. However, this solution cannot be retained since a deterioration in the quality of the yarn obtained is noticed beyond a certain running speed of the belt. Indeed, for the heat-setting to be able to take place under optimum conditions, it is essential that the yarn be subjected to a heating operation and in the presence of steam during a strictly defined period.

Another solution would consist in significantly increasing the length of the tubular chambers of the installation. However, this solution has the disadvantages of raising the cost of the installation considerably and of increasing the space it takes up in the premises where the installation is situated.

Another solution would consist yet again in significantly increasing the diameter of the tubular chambers of the installation, so as to be able to widen the belt and thus enable it to convey a larger quantity of yarn per time unit. However, this solution entails a considerable and expensive modification of the installation.

The object of the present invention is to provide an installation for the heat-setting of textile yarns, enabling the objectives below, a priori incompatible, to be achieved:

- improvement of productivity,
- improvement of quality,
- without any considerable modification of the existing installation, and in particular without increasing either the length or the diameter of the tubular chambers of the installation.

The subject of the invention is thus an installation for the heat-setting of textile yarns, comprising a tubular heating and steam-treatment chamber, partially filled with water and connected at its opposite ends to two tubular cooling chambers, these chambers being traversed longitudinally by a movable belt conveying the yarn to be treated, wound in coils parallel or perpendicular to the belt, this belt extending in the tubular cooling chambers substantially in a horizontal diametral plane of these chambers, the longitudinal axis of the heating and steam-treatment chamber being offset relative to that of the cooling chambers so as to be situated at a level below that of the latter, with the result that the belt conveying the yarn to be treated extends above the longitudinal axis of said heating and treatment chamber and at a certain distance above the water contained in this chamber.

According to the invention, this installation is defined in that the belt extends at a distance above the longitudinal axis of the heating and treatment chamber between 1/10 and 1/6 of the diameter of the chamber, and in that the width of said belt is greater than 60% of the diameter of the chamber, and in that the water level in the chamber is situated at more than 1/10 of its diameter below the longitudinal axis of this chamber.

In the installation according to the invention, the belt thus extends at a distance above the longitudinal axis of the heating and treatment chamber which is significantly less than in the above-described known installation (1/10 to 1/6 of the diameter of the chamber instead of 10 cm, or ¼ of the diameter).

Because the belt has been brought significantly closer to the longitudinal axis of the chamber, the applicant has also been able to increase significantly the width of the belt, to a point such that the latter is greater than 60% of the diameter of the chamber, whereas this width does not reach 50% of the abovementioned diameter in the known embodiment.

In order to be able to bring the belt nearer to the longitudinal axis of the chamber and to increase the width of the belt, it has also been necessary to reduce the water level in the chamber in order to avoid any risk of contact between this water and the yarn to be treated. The applicant has noted that it was possible, without any risks, to lower the water level to above 1/10 of the diameter of the chamber beneath the longitudinal axis of this chamber.

The invention thus enables the width of the belt conveying the yarn to be treated to be increased, and consequently the productivity of the installation to be increased without modifying the diameter of the tubular chambers, their length or the speed at which the belt runs inside the installation.

The modifications provided according to the present invention are consequently inexpensive.

Moreover, the applicant has been able to note that the modifications provided according to the present invention do indeed result in a significant increase in the quality of the yarns treated, which was one of the declared aims in addition to productivity.

This increase can be explained as follows: because of the increase in the width of the belt conveying the yarn, the difference in yarn density between the zone situated near the edges of the belt and the central zone is reduced. The heat-setting treatment is thus carried out under conditions which are significantly more uniform than in the known installation, this being manifest by the fact that the faults indicated above are much less visible on the textile articles made using the treated yarn.

This increase in the quality of the yarn obtained is surprising because a person skilled in the art could not establish beforehand any correlation between the position of the belt inside the heating and treatment chamber and the quality of the treated yarn.

According to an advantageous version of the invention, the belt extends at approximately ⅛ of the diameter of said chamber above the longitudinal axis of the latter.

According to a preferred version of the invention, the water level in said chamber is situated at more than ⅛ of its diameter below the longitudinal axis of this chamber.

In the case of an installation comprising tubular chambers having a 400 mm diameter, the belt extends at approximately 50 mm above the longitudinal axis of this chamber, the water level is situated at more than 50 mm below the abovementioned longitudinal axis, and the width of the belt is equal to approximately 260 mm.

By way of comparison, in the known installation, the belt is situated 100 mm above the longitudinal axis of the chamber, the water level virtually reaches this axis, and the width of the belt is equal to 200 mm.

As compared with this installation, the invention permits an increase in productivity close to 30% and an increase in quality of the same proportions.

Other features and advantages of the invention will become apparent from the description below.

Figure 2:
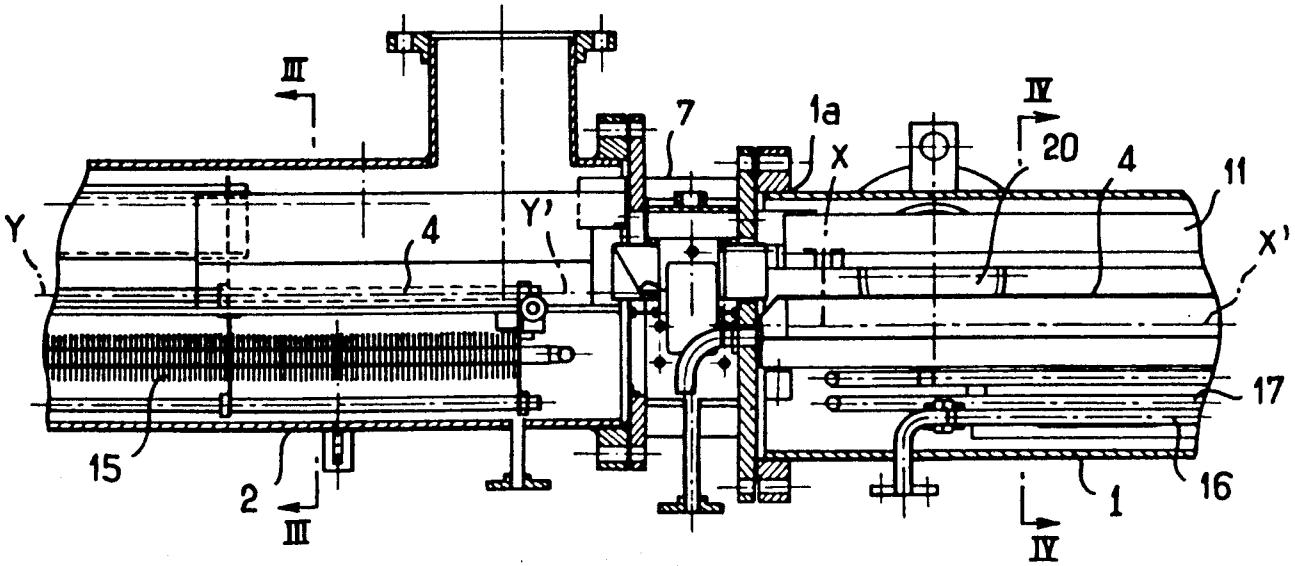
Figure 3:
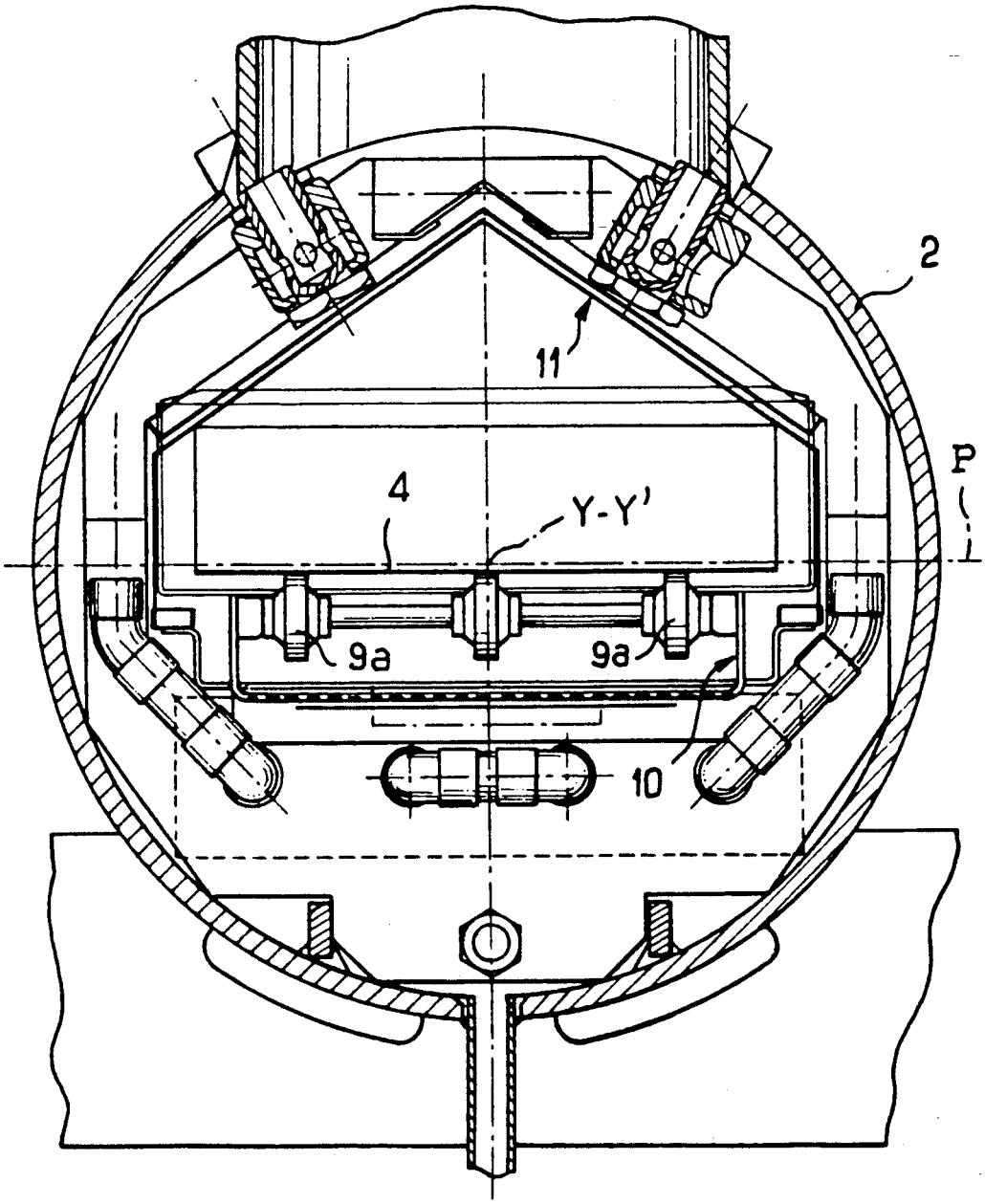
Figure 4:
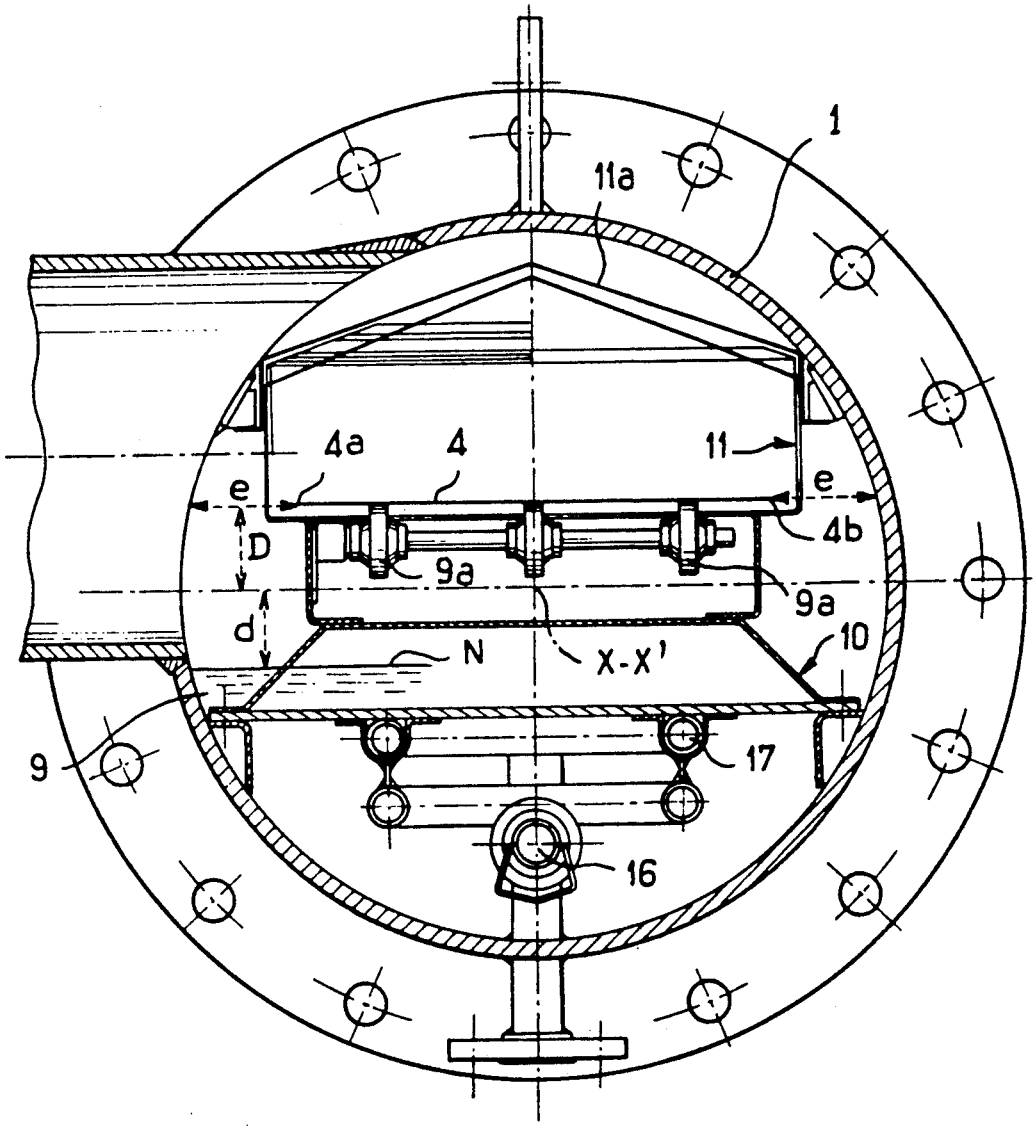
Figure 5:
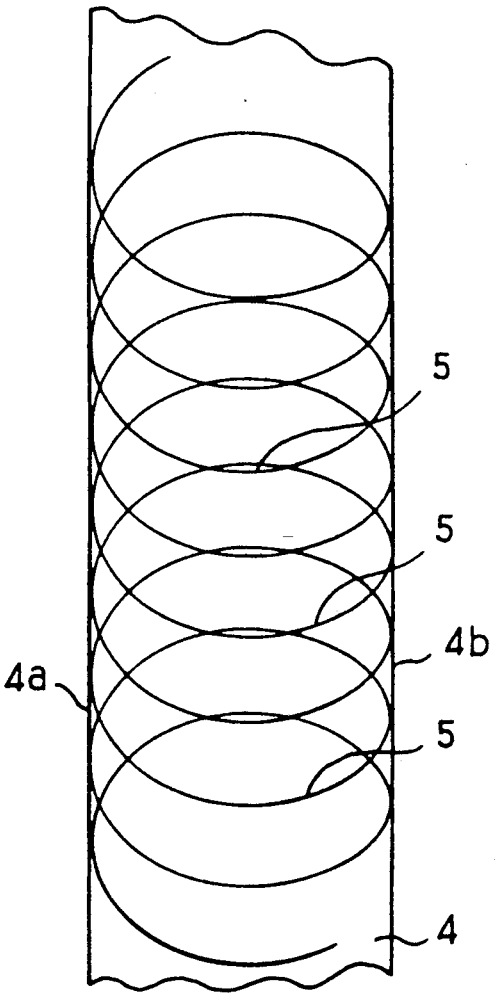
Figure 6:
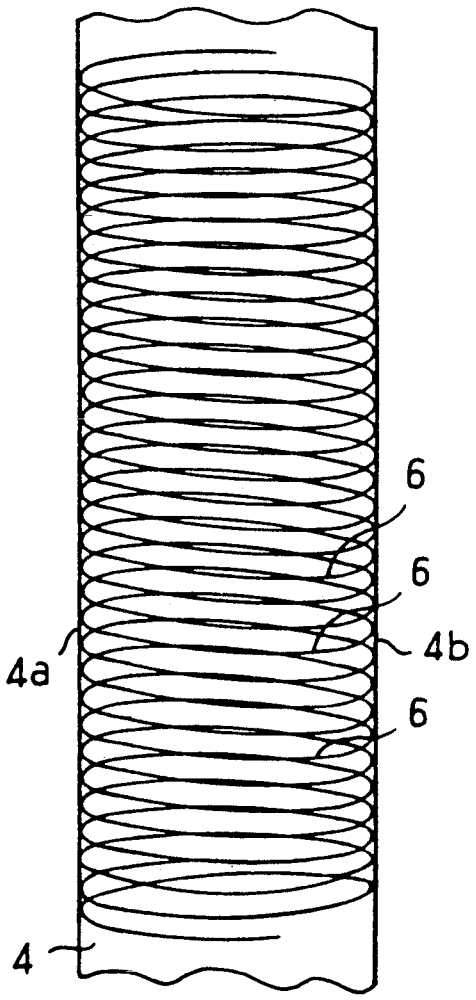

In the attached drawings, given by way of non-limiting examples:

FIG. 1 is a view in diametral longitudinal section, with cutaway, of a heat-setting installation according to the invention, FIG. 2 is a view in longitudinal section, on a larger scale, of part of the installation, FIG. 3 is a cross-sectional view on a larger scale, along the plane III—III in FIG. 1, and FIG. 4 is a cross-sectional view, on a larger scale, along the plane IV—IV in FIG. 1, FIG. 5 is a plan view showing the arrangement of the yarn to be treated on the belt, in the form of loops extending flat on this belt, FIG. 6 is a plan view showing the arrangement of the yarn to be treated on the belt, in the form of loops extending substantially perpendicularly to this belt.

Before describing in detail the installation according to the invention, the principle of the heat-setting of textile yarns, such as polyamide, acrylic polyester, polypropylene or wool yarns, will be explained briefly.

The purpose of this heat-setting is to set the individual fibers constituting a textile yarn. The setting of the fiber consists in modifying its molecular structure so as to make it resilient and to permit the yarn composed of its heat-set fibers to deform under the effect of mechanical actions (washing, cleaning, vacuum-cleaning, treading, etc.) and then to return to its initial position and shape like a spring. The modification of the molecular structure takes place by applying the sufficient amount of energy to the fiber, by raising its temperature to a level essentially dependent upon the nature of the fiber and on the desired degree of heat-setting. Saturated steam is, in this context, the ideal fluid as it is free of oxygen and can transmit its energy to the fibers very quickly.

Furthermore, under the effect of heat-setting, the fibers become stabilized dimensionally, sometimes contract, and above all develop their crimp individually. These various and combined phenomena produced a bulked, large-volume yarn which is pleasant to touch, and resilient, returning to its initial structure (fixed torsion) after mechanical deformation. When used for carpets, these yarns form strong products which preserve their initial texture and their new look for a long time.

The installation according to the invention shown in FIG. 1 essentially comprises a tubular chamber 1 of circular section in which the heat-setting of the textile yarn is carried out, at a temperature of the order of 105° to 150° C. and under an absolute saturated water vapor pressure of 1.3 to 5 bar. These temperatures and this pressure depend upon the nature of the yarn to be treated and on the desired degree of heat-setting.

This chamber 1 for treatment with heat and under steam pressure is extended at its opposite ends 1*a*, 1*b* by two cooling chambers 2, 3 in which cooling means maintain inside them a temperature between 40° and 70° C.

These three chambers 1, 2, 3 are traversed longitudinally by a movable belt 4, for example consisting of a flexible stainless-steel perforated band, conveying the yarn to be treated.

The yarn to be treated is conveyed on the belt 4 either in the form of elliptical coils wound parallel to the belt, in other words flat, as indicated by the reference 5 in FIG. 5, or in the form of substantially joined coils perpendicular to the belt 4, as indicated by the reference 6 in FIG. 6.

In the cooling chambers 2, 3, the belt 4 extends substantially in a horizontal diametral plane P of these chambers, as can be seen in FIG. 3.

It can, moreover, be seen in FIG. 1 that the longitudinal axis X—X' of the heating and steam-treatment chamber 1 is offset relative to the axes Y—Y' of the cooling chambers 2, 3 and is thus situated at a level below that of the axes Y—Y'.

To this end, the ends of the cooling chambers 2, 3 are connected to the opposite ends 1*a*, 1*b* of the heating and steam-treatment chamber 1 by way of oblique connection pieces 7, 8.

By virtue of this arrangement, the belt 4 conveying the yarn to be treated extends at a certain distance D above the longitudinal axis X—X' of the heating and steam-treatment chamber 1 (see in particular FIG. 4).

In the prior installation developed by the applicant, the diameter of the chambers 1, 2, 3 was equal to 400 mm, and the abovementioned distance D was 100 mm.

The lower part of the heating and pressurized steam-treatment chamber 1 is filled with water 9, the level N of this water being situated at a certain distance d (see FIG. 4) below the longitudinal axis X—X' of the chamber 1. In the known installation, the level N of the water substantially reaches the longitudinal axis X—X' of the chamber 1.

Before defining the improvements made by the invention, the other known features of the heat-setting installation will be described briefly.

At the opposite ends 2*a*, 3*a* of the cooling chambers 2, 3 there are arranged metal bellows (not shown) capable of absorbing the thermal expansions, and having at their respective ends opposite the adjacent cooling chamber a known device enabling the belt 4 conveying the yarn to be treated to be introduced into, and led out from the installation, in a leaktight manner. These closing devices at the entrance and exit of the installation thus enable a high air and water vapor pressure to be maintained inside the installation.

It can be seen in particular in FIGS. 3 and 4 that the belt 4 is mounted on rollers 9*a*, which are for example mounted on ball bearings which are supported by a sheet-metal structure 10 which is fixed inside the chambers 1, 2, 3.

An empty space delimited above and laterally by a sheet-metal structure 11 is arranged above the belt 4. The upper part 11*a* of this sheet-metal structure has the shape of an inverted V so as to define on either side of the vertex two downwardly inclined slopes on which the water condensing on the inner surface of the chambers 1, 2, 3 can run off. The lateral ends of this inverted-V-shaped structure are situated beyond the longitudinal edges 4*a*, 4*b* of the belt 4. There is thus no risk of the water which has condensed falling onto the yarn conveyed by the belt 4.

By virtue of the presence of the sheet-metal structure 11, the belt 4 cannot extend over the entire width of the chambers 1, 2, 3 and a certain gap e (see FIG. 4) must therefore be maintained between the edges of the belt and the inner surface of the chamber.

The arrangement of the belt 4 in the diametral plane of the cooling chambers 2, 3 is the best possible because it theoretically enables the width of the belt 4 to be increased so as to improve the productivity of the installation. However, the arrangement of this belt 4 above the longitudinal axis Y—Y' of the heating and pressurized steam-treatment chamber 1 limits the possibilities of widening said belt 4, as shown in FIG. 4.

The installation furthermore comprises flexible flaps (not shown) at the entrance and exit of the heating and steam-treatment chamber 1 which enable the heat losses to the adjacent cooling chambers 2, 3 to be limited.

The entrance 2 and exit 3 cooling chambers mainly comprise a longitudinal radiator 15 (see FIG. 2) cooled by circulating water.

The heating and vaporization chamber 1 mainly comprises longitudinal ducts 16 for the direct injection of pressurized steam, and indirect steam ducts for hot water 17. When in service, these ducts 16 and 17 are submerged in the water 9 contained in the chamber 1. These ducts enable the water 9 to be heated up, thus producing steam indirectly in the chamber 1, and are associated with a control system in order to control the desired temperature and pressure. This principle of the production of steam by a mass of water inside the machine permits a better distribution and a better homogenization of the temperature over the entire length of the chamber 1, and a more accurate control as a result of the inertial thermal mass.

The wall of the chamber 1 furthermore has, near its end adjacent to the exit cooling chamber 3, tubular connections 18, 19 of large cross-section, intended to be connected to a turbine (not shown) extracting the steam from inside the chamber 1 in order to reinject it inside the latter through an opening 20 (see FIG. 2) situated near the entrance cooling chamber 2.

This arrangement enables a uniform agitation of the pressurized steam to be ensured inside the chamber 1.

Other accessories such as temperature and pressure probes, and safety valves, serving for the functioning of the installation and for controlling of the temperature and pressure have not been shown in the figures.

The differences existing between the installation according to the invention and the known one having the features which have just been described will now be detailed.

A first difference lies in the fact that the belt 4 conveying the yarn to be treated has been considerably lowered inside the heating and steam-treatment chamber 1. This belt 4 is now situated at a distance D (see FIG. 4) which is equal to a value between 1/10 and 1/6 of the diameter of the chamber. The preferred distance D is equal to ⅛ of the diameter of the chamber, that is 50 mm for a diameter equal to 400 mm. This distance D is only equal to half of that, equal to 100 mm, employed in the known installation.

The lowering of the belt 4 has made it possible for it to be widened, to a point such that it now accounts for more than 60% of the diameter of the chamber 1. Thus, for a chamber 1 of diameter equal to 400 mm, the width of the belt 4 is greater than 260 mm, whereas it was of the order of 200 mm in the known installation.

Furthermore, the level N of the water 9 contained in the chamber 1 has been lowered considerably below the longitudinal axis X—X' of this chamber. This water level N is thus now situated at more than ⅛ of the diameter of the chamber 1 below the axis X—X', which corresponds to more than 50 mm in the case of a chamber having a diameter of 400 mm.

The above modifications have given rise to secondary modifications, such as the modification of the sheet-metal structures 10 which support the rollers 9*a*, and the sheet-metal structures 11 situated above the belt 4 for deflecting the condensation waters toward the two gaps existing between the edges of the belt 4 and the inner surface of the wall of the chamber 1.

It has, moreover, been necessary to improve the accuracy of the thermal-controlling means in order to take into account the lowering of the water level, and hence of the smaller water volume in the chamber 1.

The above modifications to the installation consequently imply no modification of the dimensions of the chambers and are limited almost entirely to modifications of elements inside the chamber 1 (the belt 4, its supports and the sheet-metal structure above the belt).

The widening of the belt 4 enables the productivity of the installation to be increased by close to 30% without modifying the running speed of the belt 4.

Furthermore, this widening of the belt 4 enables the quality of the treated yarn obtained to be improved in the same proportions. This surprising improvement can be explained a posteriori as follows.

As indicated in FIGS. 5 and 6, the density of the yarn wound in coils 5 or 6 extending over the belt 4 is higher near the longitudinal edges 4*a* and 4*b* than in the central part. The consequence of this lack of uniformity of the density is that the heat-contraction of the treated yarn takes place under different conditions in the zone of the edges of the belt than elsewhere. As a result, the textile articles made using such a yarn can have cyclic repeated faults visible in the final product.

Because of the significantly increased width of the belt 4, the difference in the density of the yarn between the zones of the edge and the central zone is significantly smaller, with the result that the abovementioned faults will be both less perceptible and more spaced out on the textile article made using the yarn treated in an installation according to the invention.

Another very important advantage provided by the improved installation according to the present invention lies in the fact that the lowering of the belt 4 in the heating and pressurized steam-treatment chamber 1 permits a space both higher and wider to be freed above the yarn extending over the belt. This enlarged space avoids the risks of the yarn piling up in this space, and in any case if such a pile-up happened, it would be easier to extract the yarn from the installation.

The invention is not, of course, limited to the illustrative embodiment which has just been described, and numerous modifications can be made to this embodiment without going beyond the scope of the invention.

I claim:

1. An installation for the heat-setting of textile yarns, comprising a tubular heating and steam-treatment chamber (1), partially filled with water and connected at its opposite ends to two tubular cooling chambers (2, 3), these chambers (1, 2, 3) being traversed longitudinally by a movable belt (4) conveying the yarn to be treated, deposited in successive parallel circular coils (5) or in successive oblong coils (6) perpendicular to the belt, and thus forming a layer which occupies substantially the entire width of this belt, this belt (4) extending in the tubular cooling chambers (2, 3) substantially in a horizontal diametral plane of these chambers, the cooling chambers (2, 3) having a longitudinal axis and the heating and steam-treatment chamber (1) having a longitudinal axis (X—X') disposed lower than the longitudinal axis of the cooling chambers (2, 3), with the result that the belt (4) conveying the yarn to be treated extends above the longitudinal axis (X—X') of said heating and treatment chamber (1) and at a certain distance above the water contained in this chamber, wherein the width of said belt (4) is greater than 60% of the diameter of the heating and steam-treatment chamber (1), and wherein the water level (N) in this chamber (1) is situated at more than 1/10 of its diameter below the longitudinal axis (X—X') of this chamber (1).

2. The installation as claimed in claim 1, wherein the belt (4) extends at approximately ⅛ of the diameter of said heating and steam-treatment chamber (1) above the longitudinal axis (X—X') of the heating and steam-treatment chamber.

3. The installation as claimed in claim 1, wherein the water level (N) in said heating and steam-treatment chamber (1) is situated at more than ⅛ of the diameter of this chamber below the longitudinal axis (X—X') of this chamber.

4. The installation as claimed in claim 1, said heating and steam-treatment chamber (1) having a diameter of 400 mm, wherein the belt (4) extends at approximately 50 mm above the longitudinal axis (X—X') of this chamber, wherein the water level (N) is situated at more than 50 mm below the above-mentioned longitudinal axis (X—X') of the heating and steam-treatment chamber, and wherein the width of the belt (4) is equal to approximately 260 mm.

* * * * *